US005855770A

United States Patent [19]

Clark et al.

[11] Patent Number: 5,855,770

[45] Date of Patent: Jan. 5, 1999

[54] BASE METAL MINERAL FLOTATION PROCESSES

[75] Inventors: David Clark; Andrew Newell, both of Chatswood, Australia

[73] Assignee: Boc Gases Australia Limited, Australia

[21] Appl. No.: 562,581

[22] Filed: Nov. 24, 1995

[30] Foreign Application Priority Data

Nov. 25, 1994 [AU] Australia ..... PM9691

[51] Int. Cl.[6] ..... B03D 1/02; B03B 1/04

[52] U.S. Cl. ..... 209/166; 209/167; 241/18; 241/24.25

[58] Field of Search ..... 209/166, 167, 209/5, 901; 252/61; 241/18, 24.25

[56] References Cited

U.S. PATENT DOCUMENTS

| | | |
|---|---|---|
| 1,334,733 | 3/1920 | Callow . |
| 1,505,323 | 8/1924 | Eberenz . |
| 3,642,464 | 2/1972 | Dorenfeld . |
| 3,655,044 | 4/1972 | Delaney . |
| 3,883,421 | 5/1975 | Cutting et al. . |
| 4,011,072 | 3/1977 | Holman et al. . |
| 4,231,859 | 11/1980 | Huiatt et al. . |
| 4,515,688 | 5/1985 | Vargas . |
| 4,585,549 | 4/1986 | Malghan . |
| 4,650,569 | 3/1987 | Vargas . |

FOREIGN PATENT DOCUMENTS

| | | |
|---|---|---|
| B-75707/81 | 4/1982 | Australia . |
| B-69283/87 | 9/1987 | Australia . |
| A-48870/93 | 4/1994 | Australia . |
| 1070034 | 1/1980 | Canada . |
| 35090 | 5/1985 | Chile . |
| 37650 | 11/1989 | Chile . |
| 1401-93 | 3/1995 | Chile . |
| 636030 | 12/1978 | Russian Federation . |
| WO 89/00457 | 1/1989 | WIPO . |

OTHER PUBLICATIONS

Castro et al, "Chemical Factors in Sulphidisation of Copper Oxide", *International Journal of Mineral Processing,* vol. 1, pp. 141–149 (1974).

Redfearn et al, "The Role of Nitrogen in the Flotation of By–Product Molybdenite at Gibraltar Mines", *Society of Mining Engineers of AIME,* for presentation at the SME–AIME Annual Meeting, Atlanta, GA (1983).

Jones et al, "Evaluation of Ion–Selective Electrode for Control of Sodium Sulphide Additions During Laboratory Flotation of Oxidised Ores", *Trans. Imm. Part C,* p. C99 et seq. (1978).

Fleming, M.G. "Effects of Soluble Sulphide in the Flotation of Secondary Lead Minerals", *Recent Developments in Mineral Dressing, Institute of Mining and Metallurgy,* p. 521 et seq (1953).

Fuerstenau, M.C. et al, "The Surface Characteristics and Flotation Behaviour of Anglesite and Cerussite", *International Journal of Mineral Processing,* pp. 73–85 (1987).

*Primary Examiner*—Thomas M. Lithgow

*Attorney, Agent, or Firm*—Burns, Doane, Swecker & Mathis, L.L.P.

[57] ABSTRACT

A process for recovering a secondary base metal mineral from a material containing it involving treatment of a pulp of the material with surface modifying reagent such as a water soluble sulphide. The pulp is subjected to deaeration by introduction of a non-oxidising gas to prevent oxidation of the reagent. The process is applicable to recovery of secondary minerals such as azurite, malachite, cerussite, anglesite and zinc ferrites from host materials.

45 Claims, No Drawings

BASE METAL MINERAL FLOTATION PROCESSES

FIELD OF THE INVENTION

This invention relates to the separation of copper and other base metal minerals, especially secondary copper, lead and zinc minerals, at higher grade and recovery from minerals with which they are associated such as sulphides, oxides or silicates, for example copper, lead, zinc or other base metal sulphides, iron oxides or quartz.

BACKGROUND TO THE INVENTION

Secondary base metal minerals occur mainly where the original sulphide ore body has been converted by chemical weathering to a partially or substantially oxidised form. Such deposits are mineralogically complex and may comprise a host of secondary minerals.

In the case of copper, relevant minerals include native copper (Cu), malachite ($Cu_2(OH)_2\ CO_3$), brochantite ($Cu_4(OH)_6\ SO_4$), antlerite ($Cu_3(OH)_4SO_4$), atacamite ($Cu_2(OH)_3\ Cl$), azurite ($Cu_3(OH)_2(CO_3)_2$), chrysocolla ($CuSiO_3.2H_2O$), cuprite ($Cu_2O$) and tenorite (CuO) as reflected for example in Hiskey, "In Situ Leaching Recovery of Copper—What's Next?", Biomine '94 Conference, Perth, Western Australia. These minerals may occur in association with gangue minerals such as silicates, e.g. quartz, iron oxides, e.g. goethite and haematite. The secondary minerals may also be associated with high value sulphide minerals, such as copper sulphides, being for example, chalcocite ($Cu_2S$) and covellite (CuS) or substituted copper sulphides, for example, chalcopyrite ($CuFeS_2$), bornite ($Cu_5FeS_4$), enargite ($Cu_3AsS_4$), tetrahedrite ($Cu_{12}As_4S_{13}$) and tennantite ($Cu_{12}As_4S_{13}$). In addition, free or mineralised precious metals such as silver or gold may be present. As the mineralogy of the host orebody is complex, the metallurgy of separation of the various constituents of the host orebody has been correspondingly complex.

In the case of lead, minerals which may be included are cerussite ($PbCO_3$), pyromorphite ($Pb_5\ Cl(PO4)3$), and the complex lead-vanadium minerals of South West Africa, the latter as discussed at length by Fleming in the paper "Effects of Soluble sulphide in the Flotation of Secondary Lead Minerals", Recent Developments in Mineral Dressing, Institute of Mining and Metallurgy (1953), p521 et seq. Specific minerals of interest may include vanadinite [$3Pb_3(VO_4)_2\ PbCl_2$) and descloizite [$(PB,Zn)_3(VO_4)PbZn(OH)_2$]. In the case of zinc and lead, an important source of secondary minerals includes the ferritic residues left after acid leaching of roasted zinc sulphide concentrates. Such residues are rich in lead and other base metals in the form, for example, of zinc ferrite and plumbojarosite or lead sulphate (anglesite) and may grade up to 20% lead when concentrated by flotation.

Zinc minerals of interest may include smithsonite ($ZnCO_3$), willemite ($Zn_2SiO_4$) and zincite (ZnO).

Partially oxidised minerals may also be encountered at mine sites where freshly mined sulphide ore may oxidise and separation behaviour be adversely affected. For example, chalcopyrite and chalcocite may at least partially oxidise following mining.

U.S. Pat. No. 3,883,421 (Cutting et al) discusses a process wherein a sulphidising agent is added to a pulp of an ore containing secondary copper minerals. The sulphidising agent may, for example, be a water soluble sulphide such as sodium sulphide or bisulphide. The sulphidising agent reacts with sulphidisable components, for example oxide minerals, in the pulp thereby forming a thin layer of sulphide on grains of the oxide minerals which are susceptible to collectors. This enables flotation of the sulphidised oxide minerals. Avoidance of excessive addition of sulphidising agent, that is, a quantity greater than stoichiometrically required, is attempted by controlling the addition of the sulphidising agent in accordance with a predetermined optimal range of oxidation-reduction potential for each specific ore type.

U.S. Pat. No. 4,011,072 (Holman et al) discloses a copper recovery process in which the EMF of a pulp of oxidised copper minerals as well as sulphide minerals is monitored. Water soluble sulphide is added to the pulp whenever and for so long as the pulp EMF is above about −30 mV with reference to a standard silver-silver chloride electrode. Reagent addition is discontinued whenever the EMF is less than about −30 mV. Following conditioning, the pulp is subjected to a froth flotation operation in the presence of a collector for copper sulphide minerals to produce a bulk concentrate containing most of the sulphide minerals and a substantial part of the oxidised minerals of the ore.

Jones et al., "Evaluation of Ion-Selective Electrode for Control of Sodium Sulphide Additions during Laboratory Flotation of Oxidised Ores", Trans. IMM, Part C, pp C99–C105 also relates optimal addition of sulphidising agent to appropriate electrochemistry and proposes a modern sulphide-ion selective electrode as the most promising method for measurement and control of sulphide concentrations in a pulp.

U.S. Pat. No. 4,585,549 (Malghan) discusses a further process for recovery of oxidised copper sulphide minerals from sulphide copper minerals in which an ore pulp is conditioned with an alkaline reagent followed by a second conditioning step in the presence of a collector. A surface modifying agent is then added to the conditioned ore pulp at a rate and in an amount sufficient to decrease the platinum electrode potential of the pulp, when measured against a standard colomel electrode, to a minimum of −100 mV. The ore pulp is then conditioned for a time sufficient to achieve intimate contact between the ore particles, and thereafter subjecting the so treated ore to conventional flotation.

Fleming (op cit) mentions a treatment scheme for an ore containing cerussite, vanadinite and descloizite involving the formulation of a pulp of these minerals and treating them with a sulphidisation agent for flotation.

SUMMARY OF THE INVENTION

It is an object of the present invention to provide a process for recovery of a secondary base metal mineral from a material containing same with higher recovery, higher grade and lower consumption of sulphidising or surface modifying compounds than has heretofore been possible. In such manner, recovery costs for secondary base metal mineral processing plants, for example, may be reduced and profitability correspondingly improved.

With this object in view, the present invention provides a process for recovering a secondary base metal mineral component from a material containing the mineral component comprising the steps of:

preparing a pulp of the material containing the secondary base metal mineral;

treating the pulp with a substantially non-oxidising gas and a oxidisable surface modifying reagent; and subjecting the treated pulp to flotation to recover the secondary base metal mineral.

The secondary base metal mineral may be a weathered, oxidised or chemically altered mineral, possibly a sulphide, and is typically of the type above described. Carbonate or hydrated secondary minerals, in particular malachite and azurite and cerussite may be of special importance. Other minerals of significance may include brochantite, antlerite, atacamite, chrysocolla, cuprite and tenorite. Sulphates, for example anglesite ($PbSO_4$) or more complex minerals, plumbojarosite or zinc ferrites, as possibly encountered in electrolytic zinc operations, may also be of importance.

Residues from leaching in electrolytic zinc residues may have sufficient base metal grade that economics dictate recovery by flotation in accordance with the process of the invention.

Mixtures of valuable base metal sulphide minerals may occur within the material and are also susceptible to recovery though care in addition of the surface modifying reagent may be required to prevent depression and loss of economically valuable sulphide minerals.

Other minerals of base metals such as iron and nickel may also be of importance. For example, the process may be suitable for recovery of oxidised or partially oxidised pyrites.

The treatment step with non-oxidising gas, with surface modifying reagent, is usually a discrete conditioning step of the pulp prior to flotation, and may also occur during milling.

The material, or an ore or concentrate from which the material is sourced, may typically also contain a second mineral component including a gangue mineral, a sulphide mineral or a mixture of these. Of special importance are oxidic, calcareous and siliceous gangue minerals and copper lead, zinc or other sulphides, which may be partially oxidised. Where the second mineral component includes sulphide minerals, being typically a copper sulphide mineral such as covellite, chalcocite, chalcopyrite, digenite or bornite, a zinc sulphide mineral such as sphalerite, or a lead sulphide mineral such as galena, it may be advantageous to separate this mineral in an initial flotation step preceding the treatment step, a strategy which may overcome the depression effects above described and provide better grade and/or recovery. Conditioning prior to this flotation stage may involve treatment of the pulp with non-oxidising gas. As precious metals, including free gold and silver, as well as mineralised forms of these metals, may be associated with such sulphides, separation of this component may also occur in the initial flotation step but both types of mineral may be recovered together following treatment, advantageously under close control over addition of the surface modifying reagent. The tail from the initial flotation step may then be treated in the manner above described.

In an alternative embodiment, the pulp may comprise a mixture of secondary copper, lead or zinc minerals and copper, lead or zinc sulphide minerals possibly in association with other elements of economic significance, eg other base metals, vanadium, and the separation from any gangue minerals may occur in the same step. Surface modification, especially sulphidising, of the secondary minerals, without wishing to be bound by any theory, may provide a mineral particle surface similar in collector adhesion characteristics to surfaces of sulphide minerals. Accordingly, a collector such as a xanthate may better bond with the secondary mineral and enable flotation. The copper sulphide minerals, having some natural affinity to bond with the collector, will simultaneously float in the normal manner. Thus the process is applicable to recovery of base metal minerals in general.

As the alternative embodiment may produce a tail still fairly rich in recoverable secondary base metal minerals, subsequent conditioning steps may be implemented to enable additional, surface modification, typically sulphidisation, stages, which in combination with further flotation stages allows enhanced recovery.

In this embodiment, a discrete flotation step may follow conditioning but the plant may be configured to implement the method in any of a number of ways. For example, it is well known that flotation may occur batchwise or in a stage wise continuous manner. In such a configuration, the conditioning step may be followed by an initial flotation step. The float product is recovered, the tail may then be conditioned in a secondary conditioning step and a secondary flotation step may follow. The number of stages may be varied in accordance with the degree of recovery required though the degree of recovery will necessarily be traded off against the capital and operating costs incurred in implementing additional conditioning and flotation stages.

By non-oxidising gas is meant a gas which will not cause an appreciable degree of oxidation of the surface modifying reagent by air or oxygen entrained, dissolved or otherwise contained, chemically or physically, within the pulp under conditions encountered in flotation plants. Suitable non-oxidising gases may be appropriately selected from the group consisting of inert gases and nitrogen, helium and argon are especially suitable. If desired, a mixture of these gases may be employed although carbon monoxide, carbon dioxide, methane sulphur dioxide (oxygen deficient), if desired, in admixture, may be considered. Conveniently, the non-oxidising gas is of high purity, preferably greater than 95% prime gas and more preferably greater than 99% prime gas purity.

Notwithstanding the necessity for the non-oxidising gas to have a capacity to reduce the degree of oxidation of the surface modification reagent, the gases conventionally used in the process may have small quantities, in the range of 0.01 to 15 volume percent, preferably less than 1.0 volume percent, of impurity gases, which may include air and/or oxygen, for maximum efficacy. Gases subject to this impurity criterion may be used to advantage in the process as the degree of oxidisation of the oxidisable surface modification reagent, which it is an object of the present invention to reduce, may still be reduced due to the capacity of the gas to purge oxygen or air from the pulp. In addition, because of possible improved chemical conditions, benefits in terms of grade and recovery may also, or otherwise, accrue. Consequently, the revenue from concentrate production may be increased, costs of the recovery of copper may be reduced and profitability of a copper processing operation correspondingly increased.

The gas used in the flotation step may be of the same nature as that used to avoid oxidation of the oxidisable surface modification reagent in the conditioning step. Accordingly, the flotation gas may be a non-oxidising gas such as an inert gas or inert gas mixture. The flotation gas may also be a non-oxidising gas if pre-flotation for recovery of sulphide minerals.

In an alternative embodiment, the flotation gas may be air, oxygen or oxygen enriched air and be different from the gas used during the conditioning step which might be a substantially non-oxidising gas as above described possibly in admixture with a carrier gas of different nature.

Conveniently, addition of the surface modification reagent to the pulp may be controlled in accordance with the optimal dissolved oxygen concentration or oxidation-reduction potential range for conditioning, (for example, if a sulphur containing reagent, for sulphidisation) which is ideally predetermined by trial and error for each specific ore type of interest. Addition of the reagent is then typically conducted when the monitored oxidation-reduction potential or dissolved oxygen concentration rises above the desired range and discontinued when the oxidation-reduction potential falls below the desired range. The desired range for oxidation-reduction potential would generally fall in the range −100 mV to −1000 mV as measured against silver/silver sulphide electrode ($E_S$). More preferably, $E_S$ would be within the range −200 mV to −600 mV.

In the case of dissolved oxygen concentration, it may be desired to control dissolved oxygen before, during and after conditioning. Pulp to be treated by a surface modifying reagent may advantageously have 0.5 ppm $O_2$ or higher. It may also be desirable to adjust dissolved oxygen concentration after treatment with surface modifying reagent and before conditioning with collector.

The surface modification reagent may typically be a sulphur containing reagent, for example, a water soluble sulphide in solid, solution or gaseous form. Suitable reagents may be selected from the group consisting of alkali metal and alkaline earth sulphides including sodium hydrosulphide, sodium sulphide, hydrogen sulphide, ammonium sulphide and ammonium hydrosulphide, and sulphoxy compounds, which may oxidise forming sulphate and producing potential scaling problems if, especially calcium and magnesium ions are present in the pulp, for example sodium sulphite, sodium bisulphite and sodium metabisulphite (or alkali metal or alkaline earth metal equivalents) and sulphide reagents, e.g sodium sulphide, may be preferred. Organic sulphur containing compounds such as dimethyl sulphide may also prove suitable. Most preferably, inorganic solid reagents are dissolved in, optionally deaerated, water, and introduced to the pulp, optionally but not necessarily prior to addition of other flotation regents, in accordance with measured or desired oxidation-reduction potential or dissolved oxygen concentration range as above described. The solution of reagent may be prepared such that a desired dissolved oxygen concentration is maintained in the solution.

The reagent may be dissolved into a solvent in a process involving deaeration. For example, the sulphide reagent may be mixed with deaerated water in a flotation reagent preparation system including a dissolution tank free from air or other non-oxidising gases or deaeration of water or other solvent may proceed simultaneously with dissolution, possibly by purging the solvent with a non-oxidising gas during dissolution. Purging may proceed until a desired dissolved oxygen concentration is attained.

Where an initial flotation step is employed for separation of the predominately sulphide minerals, the flotation occurs in columns or tanks generally at naturally occurring pH, though pH control may be desired and may assist in optimising the process. This initial flotation step may also preferably be preceded by conditioning stages wherein the requisite amount of acid and collector, for example specific sulphide collectors such as xanthates (especially sodium ethyl xanthate, potassium amyl xanthate and sodium secondary butyl xanthate); dithiophosphates; or thiocarbamates, are added and intimately mixed with the pulp. Oxidic mineral specific collectors might also be employed though are less preferred. The flotation step is otherwise conducted in a conventional manner.

The conditioning of the pulp with the oxidisable surface modification reagent, especially where a sulphur containing reagent, may induce basic conditions with pH greater than 9. The pH may be maintained in any desired range by requisite additions of acid; or alternatively lime, caustic or other suitable alkaline media should this be required.

The time taken in the conditioning step is of some importance. Generally, in continuous conditioning operations this time should be between 1 and 10 minutes, more preferably 2 to 6 minutes and most preferably 3 to 5 minutes.

The non-oxidising gas and/or other gas, eg. used for flotation, may be introduced to conditioning and flotation tanks by known gas diffusers, spargers or like devices as may be familiar to those skilled in the art. Similar devices may also be employed in the reagent preparation system.

The process may advantageously be conducted at ambient temperature. Temperature elevation is not seen as advantageous in itself. Indeed, as rising temperature reduces gas dissolution a negative effect may be encountered with rising temperature.

Consequent advantages to be gained by use of the process of the invention may include mechanistic advantages, such as improvement of galvanic coupling for certain ores, which may improve flotation characteristics, and process advantages which may include increased grade and recovery and minimisation of process costs. Reduction of consumption of sulphide reagent is prime among the cost factors. In addition, a capital saving may be gained by saving an estimated one flotation/conditioning stage from plants processing ores of the kind tested in the examples.

DETAILED DESCRIPTION OF THE INVENTION

The invention will be better understood from the following description made with reference to the appended examples.

EXAMPLE 1

Comparative tests were conducted for six copper ore types A–F of different mineralogical character as follows:

| Ore | Minerals | Mineralogical Composition |
|---|---|---|
| A | Cu | chalcopyrite, chalcocite, digenite, covellite, native Cu, malachite, chrysocolia, Cu in goethite. |
| | Gangue | pyrite, arsenopyrite, sericite, clays, chlorite, quartz |
| B | Cu | azurite, m alachite, pseudomalachite, Cu in goethite |
| | Au | native Au, associated with silicates |
| C | Cu | malachite, malachite associated with silica, Cu in goethite |
| | Gangue | pyrite (trace), clays, silicates, quartz, iron oxide quartz |
| D | Cu | native Cu, cuprite, chalcocite, malachite, chrysocolla, Cu in goethite |
| | Au | native Au, associated with copper sulphides and pyrite and silicates |
| | Gangues | pyrite, magnetite, silicates |
| E,F | Cu | chalcopyrite, chalcocite, digenite, bornite, malachite, chrysocolla |
| | Au | native Au, associated with Cu sulphides and pyrite |
| | Gangues | pyrite, cobaltite, arsenopyrite dolomite, quartz, silicates, E, F being sourced from different regions of an orebody, |

With flotation occurring in rougher mode with four stages of operation, each preceded by controlled potential sulphidisation (CPS). Where high grade sulphide minerals were present, pre-flotation was conducted for recovery prior to sulphidisation constituting the first stage of operation.

Automatic control of sulphidising agent addition was achieved by addition. In accordance with monitored $E_S$. A suitable electrode for this duty may be sourced from Orion Rcsearch Incorporated Laboratory Products Group under the trade mark ORION Model 94-16 which is a silver/silver sulphide electrode having sulphide concentration range $10^{-7}$ to IM.

In each case a milled ore of $P_{80}$75 microns was employed, the principal collector was PAX (potassium amyl xanthate), 200 g/t, methyl isobutyl carbinol (MIBC) 50 g/t was used as a frother though other frothers could be used and sodium sulphide as surface modifying, in this case sulphidising, reagent. Pulp was made up to density 35% solids by weight with each flotation stage having duration 5 minutes. Conditioning duration, prior to each flotation, was five minutes, collector being added after three minutes of conditioning with sulphidising agent. Sufficient sulphidising agent was added to maintain $E_S$ of the pulp at −400, −500 or −600 mV at a given nitrogen introduction rate. Nitrogen (>99.9% $N_2$) was introduced during conditioning with sodium sulphide at varying rates 0.5, 1.0, 2.0 l/min and results compared with standard practice, that is no nitrogen addition. Tests were conducted at ambient temperature.

These parameters may be varied according to ore type, reagents used etc and will not necessarily be the same for every process in accordance with the invention.

The effect of rate of addition of nitrogen, nature of conditioning and flotation gas and $E_S$ on copper grade and recovery and sodium sulphide usage for ore type A are tabulated below:

| Pulp $E_s$ (mV) | Flotation Conditioning | Conditions Flotation | Rougher Grade (% Cu) | Concentrate Recov (%) | Consumption Relative (%) |
|---|---|---|---|---|---|
| −400 | Standard | Air | 18.1 | 69.4 | 100.0 |
| | $N_2$-0.5 l/min | $N_2$ | 18.0 | 80.1 | 78.4 |
| | $N_2$-1.0 l/min | $N_2$ | 19.1 | 78.0 | 82.2 |
| | $N_2$-2.0 l/min | $N_2$ | 18.0 | 77.2 | 72.1 |
| | $N_2$-2.0 l/min | Air | 17.6 | 66.3 | 73.2 |
| −500 | Standard | Air | 18.0 | 72.4 | 100.0 |
| | $N_2$-0.5 l/min | $N_2$ | 19.1 | 76.0 | 80.7 |
| | $N_2$-1.0 l/min | $N_2$ | 17.4 | 79.2 | 83.4 |
| | $N_2$-2.0 l/min | $N_2$ | 19.4 | 78.4 | 80.9 |
| | $N_2$-2.0 l/min | Air | 18.1 | 83.0 | 84.5 |
| −600 | Standard | Air | 19.6 | 81.5 | 100.0 |
| | $N_2$-0.5 l/min | $N_2$ | 18.3 | 84.3 | 70.3 |
| | $N_2$-1.0 l/min | $N_2$ | 18.0 | 85.6 | 69.8 |
| | $N_2$-2.0 l/min | $N_2$ | 20.3 | 83.7 | 70.1 |
| | $N_2$-2.0 l/min | Air | 18.9 | 87.1 | 78.2 |

From the results may be seen that at any $E_S$ value, flotation results generally improved with addition of nitrogen and sulphidising agent consumption was reduced, by 16.6 to 30.2%.

Increasing nitrogen addition rate also assisted with best results at $E_S$-600 mV and nitrogen addition rate 2.0 $V_{min}$.

At $E_S$-600 mV, recovery improvement was in excess of 5% in conjunction with 22% saving in consumption rate of sodium sulphide.

Selected data for each of ore types are tabulated below:

| Ore Type | $E_s$ (mV) | Flotation Conditioning | Conditions Flotation | Rougher Grade (% Cu) | Results Recovery (%) | $Na_2S$ Consumption Relative (%) |
|---|---|---|---|---|---|---|
| A | −600 | Standard | Air | 19.6 | 81.5 | 100.0 |
| | | $N_2$-2.0 l/min | Air | 18.9 | 87.1 | 78.2 |

-continued

| Ore Type | $E_s$ (mV) | Flotation Conditioning | Conditions Flotation | Rougher Grade (% Cu) | Results Recovery (%) | $Na_2S$ Consumption Relative (%) |
|---|---|---|---|---|---|---|
| B | −600 | Standard | Air | 11.7 (18.0) | 51.5 (74.5) | 100.0 |
| | | $N_2$-2.0 l/min | Air | 12.4 (19.1) | 50.6 (74.7) | 77.4 |
| C | −600 | Standard | Air | 6.47 | 79.5 | 100.0 |
| | | $N_2$-2.0 l/min | Air | 6.58 | 79.0 | 80.3 |
| D | −500 | Standard | Air | 6.97 (8.57) | 69.5 (71.2) | 100.0 |
| | | $N_2$-2.0 l/min | Air | 6.59 (8.68) | 68.3 (72.7) | 70.6 |
| E | −500 | Standard | Air | 7.32 (70.3) | 97.7 (98.6) | 100.0 |
| | | $N_2$-2.0 l/min | Air | 8.16 (76.7) | 98.1 (98.8) | 69.9 |
| F | −500 | Standard | Air | 7.18 (96.9) | 97.5 (98.2) | 100.0 |
| | | $N_2$-2.0 l/min | Air | 7.08 (87.0) | 96.9 (98.3) | 75.6 |

Results in parenthesis are Au grade and recovery.

In all cases, where nitrogen gas was introduced to the conditioning cells, sulphide reagent consumption was reduced. Average copper and precious metal (where applicable) recovery and grade was also higher.

EXAMPLE 2

An oxidic copper/gold ore with mineralogical characterisation as follows:

Cu Minerals: malachite, chalcopyrite, azurite, bornite, chalcocite, chrysocolla, Cu in goethite.

Gangue: feldspar, quartz, magnetite, biotite was subjected to the controlled potential sulphidisation (CPS) process of Example 1 with sulphides being separated first with advantage in terms of reduced sulphide reagent consumption.

Results are as follows, attained dissolved oxygen concentration after sulphidisation and prior to PAX collector addition being varied by varying addition rates of nitrogen and, where applicable i.e. 5.6 ppm $O_2$ and above, adjusting the dissolved oxygen concentration by addition of an oxygen bearing gas, oxygen or air, though other oxidants may be used. The results are quoted for each dissolved oxygen concentration level.

| | Conditioning | | | |
|---|---|---|---|---|
| | Grade | | Recovery | |
| | Cu (%) | Au (g/t) | Cu (%) | Au (%) |
| Standard | 12.6 | 11.0 | 78.1 | 82.3 |
| $N_2$ Addition: | | | | |
| 0.6 ppm $0_2$ | 9.6 | 13.7 | 80.1 | 85.2 |
| 1.5 ppm $0_2$ | 12.1 | 10.7 | 78.6 | 81.0 |
| 2.6 ppm $0_2$ | 13.1 | 13.5 | 77.2 | 85.7 |
| 5.6 ppm $0_2$ | 9.5 | 8.7 | 85.4 | 84.3 |
| 9.5 ppm $0_2$ | 9.6 | 7.8 | 81.3 | 83.0 |
| 25.2 ppm $0_2$ | 8.0 | 8.0 | 83.1 | 84.7 |

Grade was observed to fall markedly with dissolved increased oxygen concentration though recovery increased suggesting loss of selectivity in flotation.

Reduction of sulphide reagent consumption averaged 24% during the above tests. Consumption is least at 0.6 ppm $O_2$.

EXAMPLE 3

A milled lead oxide ore ($P_{80}$ 38 micron), containing cerussite as the main lead mineral with minor amounts of galena (PbS) and goethite was subjected to a similar process to that described with reference to Example 1 with $E_S$ in first and second stage of flotation −500 mV and third and fourth stages −600 mV. Flotation gas was air.

The results are tabulated as follows:

| Conditioning Concentrate | | | | | | |
|---|---|---|---|---|---|---|
| | Grade | | Recovery (%) | | $Na_2S$ Consumption g/t | |
| | Pb (%) | Ag (g/t) | Pb | Ag | (%) | Relative |
| Standard | 31.9 | 169 | 92.0 | 68.5 | 1444 | 100.0 |
| Nitrogen-2.0 l/min (>99.9% $N_2$) | 34.7 | 181 | 91.4 | 68.9 | 1140 | 79.0 |

Grade and recovery increased with conditioning with nitrogen.

EXAMPLE 4

The process may also be applied to recovery of lead and/or zinc from an iron bearing residue produced by an electrolytic zinc process. The iron bearing residue may be pulped, deaerated and treated with a sulphide selected from sodium sulphide, calcium hydrosulphide or hydrogen sulphide to convert compounds of lead, zinc or other metals into sulphide forms which are amenable to flotation.

Referring to the lead moiety, this is predominately present in the residue as anglesite, $PbSO_4$, which is converted to lead sulphide in accordance with the following mechanism:

$$PbSO_4(S)+Na_2S(aq)=PbS(s)-PbS(s)+Na_2SO_4(aq) \quad (1)$$

The pulp may be deaerated and the sodium sulphide or other sulphidising agent may be prepared by dissolution in deaerated water and introduced to the pulp in the absence of air or other oxidising gases. The conditioning and flotation tanks may be maintained under a non-oxidising gas atmosphere.

The process of the invention can be practiced in a number of variations from the above. As will be observed, the above flotation operations were conducted in rougher mode with combination of concentrates occurring. This is not essential. Further, if rougher flotation is conducted as an initial flotation stage, a further cleaner flotation stage, following further sulphidisation in accordance with the present disclosure, may be conducted to produce a concentrate of improved copper grade.

The concentrates from the sulphide preflotation stage(s) may be combined with the oxide concentrates but this is not necessarily preferable for reasons of further processing constraints. For example, oxidic copper, lead or zinc lend themselves to hydrometallurgical recovery operation, as pyrometallurgical processing costs are likely to be high. Conversely, a copper, lead or zinc sulphide concentrate generally requires an initial pyrometallurgical stage to remove the sulphur and produce an oxidic calcine or sinter suitable for treatment by hydrometallurgical or pyrometallurgical operations. For example, the copper sulphide may be directly smelted or treated by matter conversion operations.

It may be appropriate to control the introduction of the non-oxidising gas to the flotation or conditioning cells in accordance with other monitored conditions such as dissolved oxygen concentration or electrochemical potential in the pulp. Further, the process may benefit from a sophisticated control regime in which the gas introduced to the conditioning and/or flotation cells is proportioned between, for example nitrogen and air, in accordance with specific ore types and electrochemical conditions. In such manner, the effective consumption of the sulphur containing reagent for a given cut-off copper grade and recovery may be reduced yet further.

Similarly, it may be appropriate to vary the nature of gases introduced to the conditioning and/or flotation cells in accordance with particular pulp electrochemistry. Also, if a cleaner flotation circuit were to be preferred as the initial stage employing surface modification, or sulphidisation, a nitrogen/air gas mixture, for example, could be utilised in conditioning and air in flotation to obtain secondary copper, lead or zinc mineral concentrate at high grade and recovery. A scavenger flotation circuit could then employ the non-oxidising gas alone as the conditioning and flotation gas, reducing the consumption of the sulphur containing reagent and assisting in the achievement of a higher copper, lead or zinc recovery albeit at lower grade. Moreover, if desired, surface modification or sulphidisation stages may also precede the rougher flotation stage(s).

It may also be beneficial to maintain the conditioning and/or flotation cells under an atmosphere of inert gas to prevent dissolution of air in the pulp at the air/pulp interface. In such a case, the inert gas may be maintained under a slightly positive pressure.

Ores need not necessarily be treated by the process. Concentrates sourced remote to the flotation plant may be treated in accordance with the process of the invention.

All such variations, as well as others which may be apparent to those skilled in the art upon reading this disclosure, fall within the scope of the present invention.

We claim:

1. A process for recovering a secondary base metal mineral component from a material containing the mineral component comprising the steps of:

preparing a pulp of the material containing the secondary base metal mineral;

conditioning the pulp by treating the pulp with a substantially non-oxidising gas and an oxidisable surface modifying reagent; and subject the conditioned pulp to flotation to recover the secondary base metal mineral.

2. The process as claimed in claim 1 wherein said base metal mineral is selected from the group consisting of copper, lead and zinc.

3. The process as claimed in claim 1 wherein said base metal mineral is a secondary copper mineral.

4. The process as claimed in claim 3 wherein said secondary copper mineral is selected from the group consisting of azurite, malachite, pseudomalachite, brochantite, antlerite, atacamite, chrysocolla, cuprite tenorite, at least partially oxidised chalcopyrite and at least partially oxidised chalcocite.

5. The process as claimed in claim 3 wherein said secondary copper mineral is associated with a copper sulphide mineral.

6. The process as claimed in claim 2 wherein said secondary base metal mineral is a lead or zinc mineral.

7. The process as claimed in claim 2 wherein said base metal mineral is associated with a base metal sulphide mineral.

8. The process as claimed in claim 6 wherein said lead mineral is selected from the group consisting of vanadinite, cerussite, plumbojarosite, anglesite and descloizite.

9. The process as claimed in claim 6 wherein said zinc mineral is a zinc mineral present in electrolytic zinc residue.

10. The process as claimed in claim 9 wherein said zinc mineral is selected from the group consisting of smithsonite, willemite, zincite and zinc ferrite.

11. The process as claimed in claim 7, wherein said base metal sulphide is recovered simultaneously with said secondary base metal mineral.

12. The process as claimed in claim 6, wherein said mineral is associated with a base metal sulphide mineral.

13. The process as claimed in claim 1 wherein said non-oxidising gas is introduced to the pulp during milling.

14. The process as claimed in claim 7, wherein said base metal sulphide is recovered prior to said conditioning step.

15. The process as claimed in claim 7, wherein said base metal sulphide is recovered simultaneously with said secondary base metal mineral.

16. The process as claimed in claim 1 wherein multiple conditioning and flotation steps are employed.

17. The process as claimed in claim 1 wherein said non-oxidising gas is selected from the group consisting of nitrogen, helium, argon, carbon monoxide, carbon dioxide, methane, sulphur dioxide and mixtures of two or more thereof.

18. The process as claimed in claim 17 wherein said non-oxidising gas contains less than 1.0 volume percent of an oxidising gas.

19. The process as claimed in claim 1 wherein flotation gas and said non-oxidising conditioning gas are the same.

20. The process as claimed in claim 1 wherein flotation gas is selected from the group consisting of air, oxygen and oxygen enriched air.

21. The process as claimed in claim 1 wherein addition of said surface modifying reagent is controlled to maintain oxidation-reduction potential or dissolved oxygen concentration of the pulp in a desired range.

22. The process as claimed in claim 21 wherein said desired range of oxidation-reduction potential is −100 mV to −1000 mV measured against silver/silver sulphide electrode.

23. The process as claimed in claim 21 wherein said desired range is −200 mV to −600 mV.

24. The process as claimed in claim 1 wherein said surface modifying reagent is a water soluble sulphide.

25. The process as claimed in claim 24 wherein said water soluble sulphide is an alkali metal or alkaline earth sulphide.

26. The process as claimed in claim 25 wherein said sulphide is selected from the group consisting of sodium hydrosulphide, sodium sulphide, hydrogen sulphide, ammonium sulphide and ammonium hydrosulphide.

27. The process as claimed in claim 24 wherein said water soluble sulphide is an organic sulphur containing compound.

28. The process as claimed in claim 24 wherein said water soluble sulphide is dissolved in water and introduced to said pulp.

29. The process as claimed in claim 28 wherein said water is deaerated.

30. The process as claimed in claim 28 wherein dissolution is accompanied by deaeration.

31. The process as claimed in claim 1 wherein conditioning duration is 1 to 10 minutes.

32. The process as claimed in claim 31 wherein conditioning duration is 2 to 6 minutes.

33. The process as claimed in claim 32 wherein conditioning duration is 3 to 5 minutes.

34. The process as claimed in claim 1 wherein non-oxidising gas is introduced to maintain a desired range of oxidation-reduction potential or dissolved oxygen concentration.

35. A process for recovery of a base metal mineral, said process comprising the steps of:

forming a pulp containing said base metal mineral;

adding an oxidisable surface modifying reagent to the pulp:

introducing a non-oxidising gas to the pulp to prevent oxidation of the oxidisable surface modifying reagent added to the pulp to render said base metal mineral amenable to substantial recovery by flotation; and subjecting the pulp to flotation to recover the base metal mineral.

36. The process of claim 35 wherein said non-oxidising gas is introduced to the pulp during milling.

37. The process of claim 35 wherein said surface modifying reagent is a sulphide.

38. The process of claim 35 wherein said base metal mineral includes a secondary base metal mineral.

39. The process of claim 35 wherein said base metal mineral is selected from the group consisting of copper, lead and zinc minerals.

40. The process of claim 36 wherein said non-oxidising gas is introduced to said pulp prior to introduction of other flotation reagents.

41. The process as claimed in claim 4, wherein said secondary copper mineral is associated with copper sulphide mineral.

42. The process as claimed in claim 12, wherein said base metal sulphide is recovered prior to said a conditioning step.

43. The process as claimed in claim 7, wherein said base metal sulphide is recovered prior to said treatment step.

44. The process as claimed in claim 12, wherein said base metal sulphide is recovered simultaneously with said secondary base metal mineral.

45. The process as claimed in claim 12, wherein multiple conditioning and flotation steps are employed.

* * * * *